United States Patent [19]

Schroedel et al.

[11] Patent Number: 4,558,527

[45] Date of Patent: Dec. 17, 1985

[54] READING AID APPARATUS, ESPECIALLY A COPYHOLDER FOR TYPEWRITERS

[76] Inventors: Helmut Schroedel; Nancy Nugent, both of 726 N. Beach Rd., Gwelup W. A., Australia

[21] Appl. No.: 699,216

[22] Filed: Feb. 6, 1985

Related U.S. Application Data

[63] Continuation of Ser. No. 442,268, Nov. 17, 1982, abandoned.

[30] Foreign Application Priority Data

| | | | |
|---|---|---|---|
| Apr. 27, 1982 | [AU] | Australia | PF3738 |
| May 5, 1982 | [AU] | Australia | PF3892 |
| Jul. 13, 1982 | [DE] | Fed. Rep. of Germany | 8220020[U] |

[51] Int. Cl.[4] ..... B41J 11/36; B41J 13/00

[52] U.S. Cl. ..... 40/343; 40/341; 40/19; 40/473; 400/718

[58] Field of Search ..... 40/156, 377, 493, 541, 40/558, 564, 571, 346, 575, 341–346, 19, 904, 506; 400/718; 116/235, 234, 240

[56] References Cited

U.S. PATENT DOCUMENTS

| | | | |
|---|---|---|---|
| 890,474 | 6/1908 | Wallin | 400/718 |
| 962,988 | 6/1910 | Steinmeyer | 400/718 |
| 1,576,028 | 3/1926 | Bowen | 40/19 |
| 1,604,914 | 10/1926 | Heebner | 400/718 |
| 1,637,384 | 8/1927 | Marlatt | 400/718 |
| 1,700,629 | 1/1929 | Douglas | 400/718 |
| 1,765,306 | 6/1930 | Harris | 400/718 |
| 2,156,553 | 5/1939 | Vendope | 40/558 |
| 2,211,559 | 8/1940 | Erickson | 40/19 |
| 2,782,539 | 2/1957 | Baker | 40/19 |
| 2,906,046 | 9/1959 | Graves | 40/473 |
| 2,949,886 | 8/1960 | Tibbling | 40/346 |
| 2,958,251 | 11/1960 | Calabro | 40/506 |
| 3,077,981 | 2/1963 | Gaspard | 40/575 |
| 3,358,396 | 12/1967 | Prince | 40/377 |
| 3,365,820 | 1/1968 | Connell | 40/493 |
| 3,468,388 | 9/1969 | Labore et al. | 40/493 |
| 3,488,880 | 1/1970 | Taylor | 40/493 |
| 3,548,524 | 12/1970 | Rohnow | 40/506 |
| 4,177,591 | 12/1979 | Thompson et al. | 40/343 |
| 4,182,059 | 1/1980 | Greene | 40/377 |
| 4,196,535 | 4/1980 | Heimo | 40/19 |

FOREIGN PATENT DOCUMENTS

| | | | |
|---|---|---|---|
| EP14317 | 8/1980 | European Pat. Off. | 40/156 |
| 2215479 | 10/1973 | Fed. Rep. of Germany | 40/473 |
| 409474 | 10/1966 | Switzerland | 116/235 |
| 1591174 | 6/1981 | United Kingdom | 40/343 |

*Primary Examiner*—Robert Peshock
*Assistant Examiner*—James Hakomaki
*Attorney, Agent, or Firm*—W. G. Fasse; D. H. Kane, Jr.

[57] ABSTRACT

The transcribing work of a typist is facilitated by a reading aid in the form of a copyholder which has a holder cylinder of transparent material into which a copy to be transcribed is insertable. A support provides for rotatably locating the copyholder substantially in the typist's line of vision toward the keyboard and the typed line. The hollow cylinder is rotatable either by hand or by a motor driven gear mechanism for stepping the cylinder from line to line of the copy. The copy is insertable either at one open end of the cylinder or through a slot in the cylinder jacket.

7 Claims, 9 Drawing Figures

READING AID APPARATUS, ESPECIALLY A COPYHOLDER FOR TYPEWRITERS

CROSS-REFERENCE TO RELATED APPLICATION

The present application is a File Wrapper Continuation of my copending application Ser. No. 442,268; filed in the U.S.A. on Nov. 17, 1982, now abandoned.

BACKGROUND OF THE INVENTION

The present invention relates to a reading aid apparatus, especially a copyholder for typewriters and similar office machines.

So-called copyholders are known in the prior art for aiding in the copying work of a typist who has to copy a manuscript or draft on the typewriter or for holding any other visual aid that may be needed by the typist. One group of such copyholders comprises a flat backing board supported by a tripod type holder and provided with a clamp or clip for securing a sheet of paper or manuscript to the backing board. An example of such a manuscript holder is disclosed in U.S. Pat. No. 693,124 granted on Feb. 11, 1902.

The copy holding device of U.S. Pat. No. 693,124 is further equipped with a ruler secured to the edge of the backing board for sliding up and down along the backing board edge. In any event, the ruler marks the line to be copied.

It is further known from U.S. Pat. No. 1,042,373 that a copy or manuscript can be secured to a platen type roller similar to that in a typewriter. Such a platen type roller is rotatable relative to a ruler.

Another group of copyholders is disclosed in French Pat. No. 2,277,549 and German Pat. No. 2,640,445. In this type of copyholder the sheet or manuscript to be read or copied is held in a clamped down, slightly bent position so that it maintains a perpendicular or slightly slanted position relative to the line of view of an observer, especially the typist.

All known prior art copy holding devices must be located adjacent to or behind a typewriter, a data processing terminal or the like so that the spacing between the line to be copied and the eyes of the typist is rather large and/or the reading of a line requires a lateral movement of the head of the typist.

OBJECTS OF THE INVENTION

In view of the above it is the aim of the invention to achieve the following objects singly or in combination:

to provide a reading aid which makes it possible in combination with a modern typewriter, data processing terminal or the like to greatly facilitate the copying work of a typist or programmer, more specifically, to minimize the spacing between the eyes of the typist and the line to be copied without any substantial change of the head position relative to the instantaneous line or location to be read;

to avoid the use of space beside or behind the typewriter for the reading aid and to place the reading aid substantially directly in the line of vision of the typist; and to construct the reading aid in such a manner that it may be placed substantially behind the keyboard of the typewriter or the like, or even inside a typewriter housing or keyboard housing.

SUMMARY OF THE INVENTION

The copyholder according to the invention comprises a transparent, hollow cylindrical body into which the manuscript or copy to be read is insertable and which may be supported directly on or directly adjacent of the typewriter, however, in such a position that the copyholder itself is located substantially in the line of vision of the typist without the need for head movements in a lateral direction. Such a device has the advantage that the sheet with the lines to be read can be brought into the most advantageous reading position relative to the line or range of vision of the typist and that the sheet itself may be held in the transparent cylinder in such a manner that the sheet cannot fold or roll back or the like. Further, the cylinder prevents any fluttering of the sheet. The hollow cylinder may be constructed in such a manner that not only single sheets, but even stenographic pads may be inserted in the cylinder thereby avoiding the reading of the stenographic manuscript with the aid of a ruler which normally is moved by hand by the typist. This type of arrangement avoids the lateral shifting of the head and also does not require any changes in the body posture of the typist in most instances.

According to one advantageous embodiment of the invention the cylinder is open at one end for the insertion of a sheet to be copied and the other end of the cylinder comprises support means for rotatably supporting the cylinder. Such supporting means may, for example, comprise two cover members fitting one into the other or two rings. According to another embodiment the cylinder is open at both ends and supported in a rotatable manner by two claw type brackets. Preferably, the hollow transparent cylinder is made of an initially flat piece of synthetic transparent material which is rolled up to form the cylinder, whereby the ends of the flat sheet extending in parallel to the rotational axis of the cylinder overlap each other to some extent to form a slot through which a sheet of paper is insertable. For practical reasons it is desirable to reinforce at least one of the sheet edges forming the slot by a reinforcing member such as a wire embedded or otherwise secured to the edge. The wire, for example, may be glued to the edge.

Preferably, the entire copyholder is equipped with one or several support means, including a leg and a base plate and pivoting means holding the components together, for example, in the form of a ball and socket structure. Such a structure permits a tiltable securing of the rotatable cylinder to the housing of a typewriter or the like. In yet another embodiment the support means may comprise a base plate equipped with so-called velcro-elements for securing the base plate, for example, to the housing of a typewriter, to a table or the like. A ruler may be secured, preferably in an adjustable or tiltable manner to the support means for indicating a line to be read. The cylinder itself may be rotated by hand or, if desired or required, a small drive motor and respective gear means may be provided for advancing the rotation of the cylinder from line to line. The rotational operation may be controlled by a foot pedal switch or by switches which may be securable to the keyboard or next to the keyboard of the typewriter.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
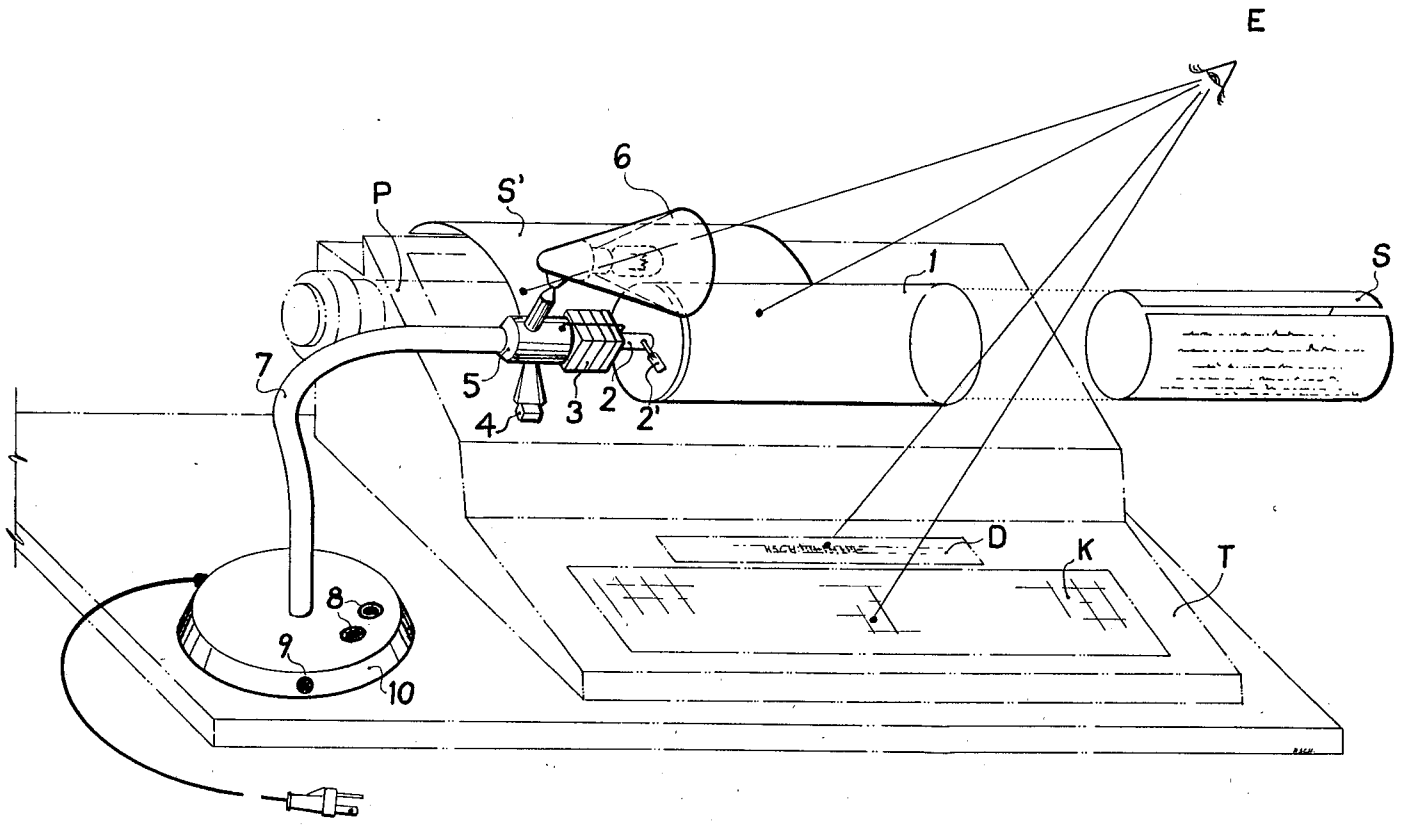
FIG. 1 is a perspective view of one embodiment of a copyholder according to the invention including a support structure for securing the entire copyholder to a table adjacent to the typewriter while positioning the copyholder cylinder directly in the range of vision of the typist.

As shown in FIG. 1 the copy holding hollow, transparent cylinder 1 is positioned according to the invention directly in the range of vision of the eye E of a typist, whereby a lateral movement of the eye outside of the range of the typewriter itself, that is movements of the head in the lateral right an left directions are avoided, and whereby the typist does not have to take up any unnatural body posture for reading a line to be copied as is necessary when the material to be copied is located to the left or right of the typewriter. As shown in FIG. 1 the typewriter T shown in phantom lines is equipped with a keyboard K with a line indicator or display D and the regular platen P. The sheet S' that is being typed runs around the platen P in the conventional manner.

The support means for the hollow, transparent cylinder 1 in FIG. 1 comprise a flexible holding member 7 which is sufficiently stiff to hold the cylinder 1 in a substantially horizontal position as shown when not acted upon. The flexible member 7 is secured to a base plate 10 which may be similar to any conventional lamp stand or base. The base plate 10 may be located on a table adjacent to the typewriter on one side thereof and the support member 7 is long enough to position the cylinder 1 so that its central rotational longitudinal axis extends substantially horizontally. The cylinder 1 is then located between the line indicator or display D and the platen P. The cylinder 1 is rotatably supported on a shaft 2 to which the cylinder may be attached in a removable manner with the aid of a wing screw 2' or the like. A drive motor 3 is operatively interposed between the shaft 2 and a holding member 5 at the upper or free end of the support member 7. The shaft 2 may be part of the motor 3 reaching into a bushing forming part of the end structure of the cylinder 1. The holding member 5 may also support a conventional lamp 6 in such a position that its light falls directly onto the cylinder 1, especially where the line presently being copied appears.

The drive motor 3 may be controlled in its operation by a pair of switches 8 arranged in the base 10, whereby the rotation of the cylinder 1 in one or the other direction may be caused by pushing the respective switch button. If desired, a foot pedal operated or hand operated switching device may also be combined with the system as is conventional. Such switching device could be plugged into the socket 9.

As mentioned, the cylinder 1 is made of a transparent tubular member, one end of which is open and the other end of which is operatively secured to the drive shaft 2 of the motor 3 as will be described in more detail below with reference to FIGS. 4 and 5.

The inner circumference of the cylinder 1 is suitably dimensioned so that a sheet, for example of paper S of standard size, may be inserted into the cylinder as shown in FIG. 1. Thus, the entire surface of the text to be copied is visible and in direct contact with the inner surface of the cylinder 1.

Incidentally, a clamp or clip 4 secured to the holding member 5 may be provided for additionally holding any material needed by the typist, such as a stenographic pad or the like.

Figure 2:
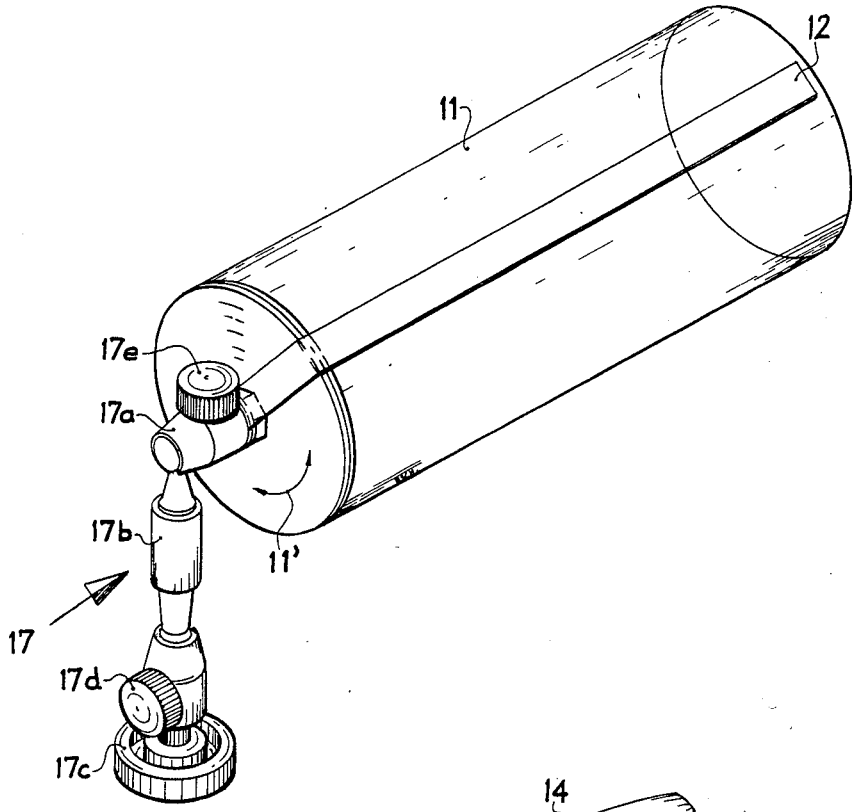
FIG. 2 illustrates a perspective view of another embodiment of a copyholder according to the invention in which the support structure permits the securing of the copyholder to a table or to the housing of an office machine.

In operation, the reading aid of FIG. 1 is positioned as shown in FIG. 1 and the operator rotates the cylinder by means of a hand switch or foot pedal switch so that the text is stepped line by line into the viewing range for copying. As shown in FIG. 2, a ruler 12 may be combined with the cylinder for sequentially marking each line being copied.

Referring to FIG. 2, the cylinder 11 is substantially of the same construction as the cylinder 1 and is also rotatable about its longitudinal horizontal axis by support means 17 comprising a cylinder holding member 17*a* to which the cylinder is rotatably secured. An extension member or leg 17*b* with a ball and socket joint is secured to the cylinder holding member 17*a* at the upper end of the extension leg 17*b*. The lower end thereof is connected to a base plate 17*c*, whereby again a ball and socket device or several such devices may be used for interconnecting the base plate 17*c* with the leg 17*b*. A screw 17*d* and a further screw 17*e* are used to fix the cylinder in the desired position. These ball and socket joints are of conventional construction and therefore not shown in further detail.

The embodiments of FIG. 2 may be located in the same manner as shown in FIG. 1 or the base plate 17*c* may be provided with means for securing the base plate to the housing surface of a typewriter, for example, by means of velcro-elements. The base plate 17*c* may also be secured to a stand or to an extension plate placed under the typewriter. Further, the central extension leg 17*b* may be of the telescoping kind so that the exact position of the cylinder 11 relative to the range of vision of the typist may be adjusted as desired in an easy manner and also with due regard to different models of typewriters and data processing terminals. Incidentally, the above mentioned ruler 12 remains stationary while the cylinder 11 rotates in one or the other direction as indicated by the double arrow 11' in FIG. 2.

Figure 3:
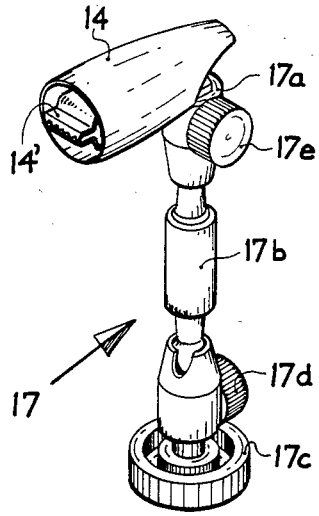
FIG. 3 shows a modification of the support structure according to FIG. 2.

As shown in FIG. 3 the support structure 17 may also be used for carrying a clamp 14 rather than the cylinder 11. The clamp or clip 14 has conventional clamping jaws 14' for holding a stenographic pad or the like. However, as mentioned above, such a pad may be entirely placed within the cylinder 11 if the latter is made to have sufficient strength for this purpose. The cylinder 11 would then be made of a respectively thick walled rigid transparent material.

It will be appreciated that the drive motor 3 could be installed instead, for example directly in the housing of a typewriter, whereby the output shaft of the motor would be connected through a flexible shaft or the like for driving the cylinder 1 or the cylinder 11. In any event, it is practical to add to the keyboard of the typewriter the required keys for operating motor control switches which, just as an example, are shown at 8 in FIG. 1. Further, it is possible to install the rotatable cylinder within the housing of the typewriter or within the housing of the typewriter keyboard, especially where the keyboard is separate from the printout means of the typewriter. In such a case the respective housing is provided with a view window which makes visible a portion of the cylinder surface for reading the text to be copied. In both instances, where the cylinder is installed in the typewriter housing, or where it is installed in the keyboard housing, the motor drive and the control keys would also be installed in the respective housing.

Figure 4:
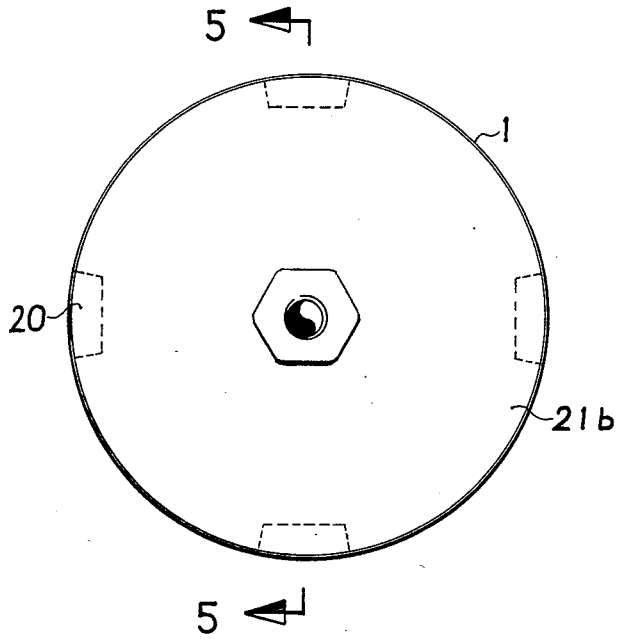
FIG. 4 shows an end view of a copyholder cylinder in the direction of the arrow A in FIG. 5.
Figure 5:
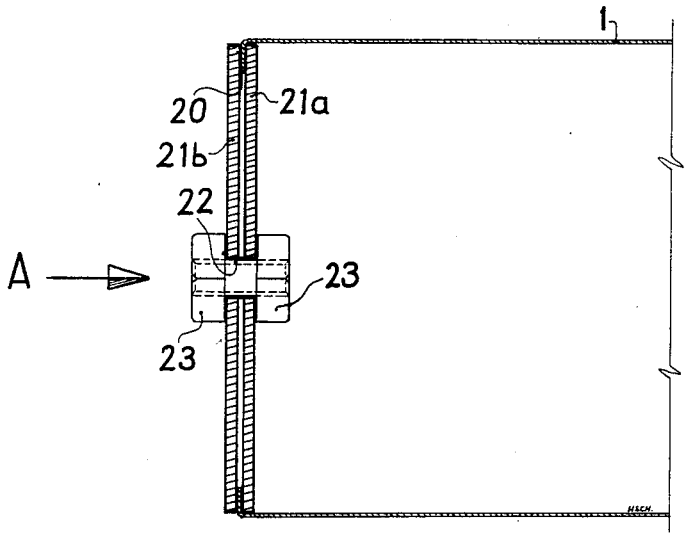
FIG. 5 shows a partial sectional view along section line 5—5 in FIG. 4 illustrating one embodiment for securing the cylinder proper to the support means as shown in FIGS. 1 and 2.

FIGS. 4 and 5 illustrate a cylinder suitable for the above described embodiments. The cylinder 1 or 11 comprises a rectangular piece of transparent synthetic material, such as celluloid which is rolled up to form a cylinder. Along the edge of the transparent sheet which, when rolled up, will form one end of the cylinder there are provided radially inwardly extending flaps 20 which are then clamped between two cover members or disks **21*a* and 21*b* as best seen in FIG. 5. One of the disks or cover members 21*a* is arranged inside the cylinder and the other cover member or disk 21*b* is arranged outside the cylinder. The flaps 20 are clamped between the disks 21*a* and 21*b* and the two disks or cover members are held together by a threaded member 22 provided with threaded nuts 23. The threaded member is conventionally constructed, for example, with a socket or bushing not shown in FIG. 5 for attachment to the drive shaft of a motor. In case the cylinder is to be rotated by hand, the threaded member 22 may be connectable to a support which permits the rotation of the shaft. Such support may also be used if the cylinder is to be driven externally, for example, by a motor and a friction wheel as will be described in more detail below. The arrangement shown in FIGS. 4 and 5** permits an easy exchange of the cylinder and also facilitates the disassembly of the device for packaging purposes.

Figure 6:
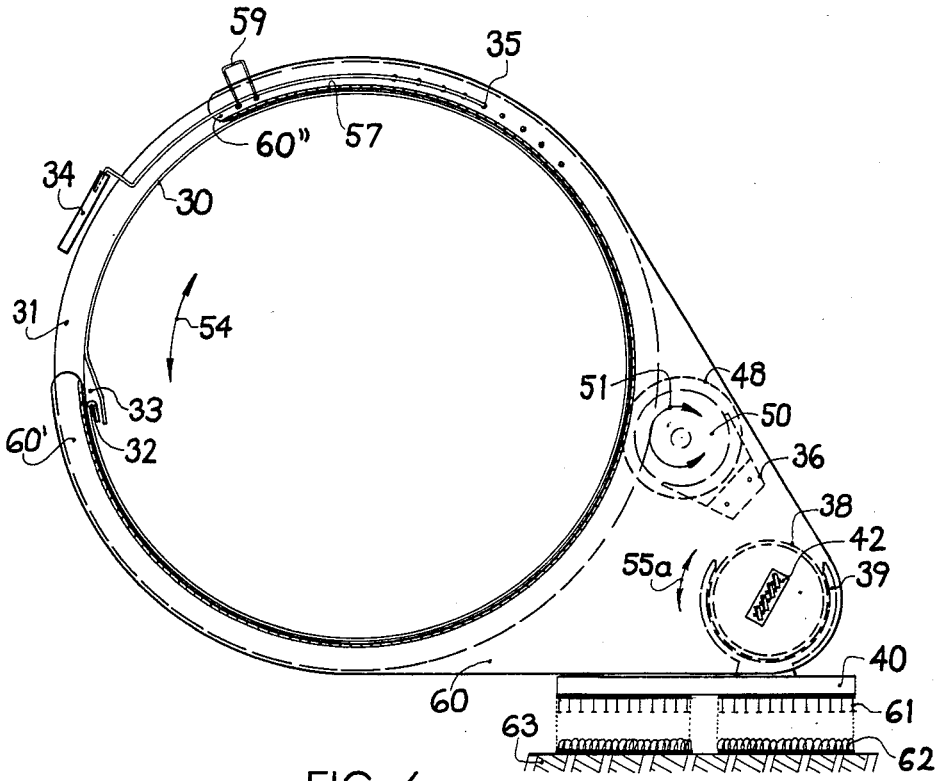
FIG. 6 shows a side or end view of another embodiment in which the cylinder is open at both ends and supported by a claw type support structure in a rotatable manner, whereby the illustration is on a substantially natural scale.
Figure 7:
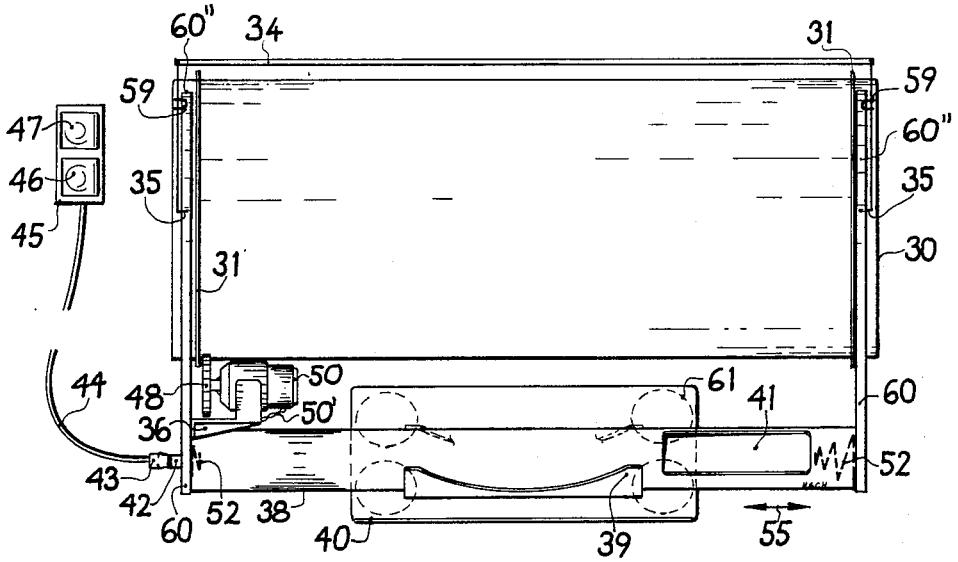
FIG. 7 is a top plan view on the embodiment of FIG. 6, however, on a reduced scale.
Figure 8:
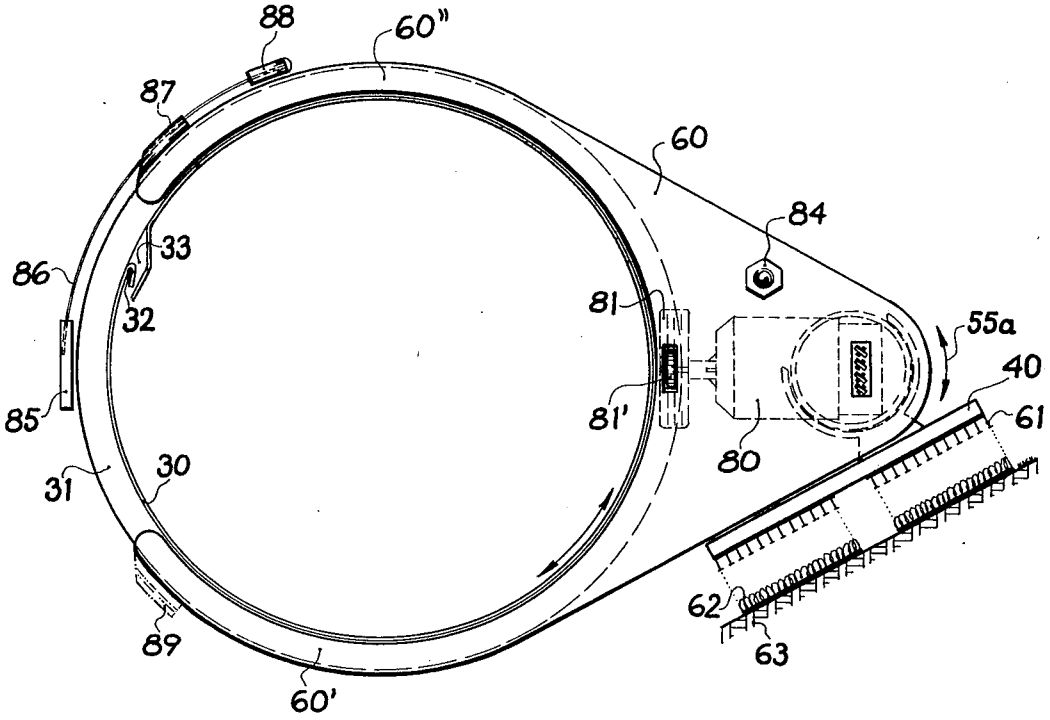
FIG. 8 is a view similar to that of FIG. 6, however, showing certain modifications.

A further embodiment of the invention is illustrated in FIGS. 6 and 7. This embodiment is suitable for attachment to the housing of a typewriter or other typing automats. The transparent cylinder 30 is made out of a sheet of transparent synthetic material open at both ends. The side view of FIG. 6 corresponds substantially to the natural size. The top plan view of FIG. 7 is shown on a reduced scale of about 2 to 1. The transparent sheet of synthetic material may, for example, have a thickness of 0.3 mm and may be made of an acetate synthetic material. By overlapping the edges of the rolled up sheet a gap 33 is formed, whereby it is preferable to reinforce the lower edge of the gap, for example, by a wire 32. Thus, individual sheets may be quickly inserted into the cylinder from its front face and the sheets may be removed laterally out of the cylinder. A flange 31 also made of transparent material surrounds the cylinder adjacent at least one end thereof preferably adjacent both ends for preventing a lateral shifting of the cylinder 30 in its support structure including two claw type holding brackets 60, each having a lower holding arm 60' and an upper holding arm 60'' forming a cradle type structure which encircles the cylinder 30 only partially as best seen in FIGS. 6 and 8. These holding arms 60' and 60'' are suitably made of synthetic material or metal and are sufficiently flexible to permit the easy insertion and withdrawal of the cylinder 30 into the grip of these holding arms 60' and 60''. By making the insertion and withdrawal of the cylinder easy as just described, it is possible to insert a sheet to be copied even where there is not sufficient lateral space available for each purpose and even where the sheet must be inserted with its long edge extending horizontally. In any event, the transparent, hollow cylinder will be constructed to be rigid enough so that an entire stenographic pad may be inserted. The inwardly facing surface of the holding arms 60', 60'' may be faced with a sliding improving or low friction material 57 such as Nylon (RTM) or Teflon (RTM) for facilitating the rotational movement of the cylinder 30.

A ruler 34, for example in the form of a piece of wire or metal strip is held in position by clamps 59 secured to the holding arms 60''. The wire ends 35 of the ruler 34 are insertable into holes in the holding arm 60'' so that upon release by the clamps 59 the ruler 34 may be tilted upwardly out of the way.

The cylinder 30 has two flanges 31 which may also be faced with a friction reducing material on the side facing the respective holding arm.

For rotating the cylinder 30 in the direction of the double arrow 54 there is provided a drive motor 50 having attached to its shaft a drive wheel such as a friction wheel 48 which contacts the cylinder surface as seen in FIG. 7. The motor 50 is secured to the holding bracket 60 by a conventional angle member 36 or the like. If desired, the cylinder may also be rotated by hand.

The lateral support brackets 60 are rigidly interconnected with each other by a round tubular member 38 which is in turn held by a clamp type slotted pipe section 39 secured to a support plate 40 equipped with velcro-elements 61 for cooperation with further velcro-elements 62 on a support surface 63 such as a portion of a typewriter housing. The slotted pipe section 39 may also be made of relatively elastic synthetic material to provide a location clamp fit between said pipe section 39 and said round tubular member 38 as seen in FIGS. 6 and 8, whereby it is possible to tilt the support structure holding the cylinder 30 up or down relative to the slotted pipe section 39 in the direction of the double arrow **55*a*. Further, it is possible to shift the entire support structure and thus the cylinder 30 axially along the round tubular member 38 to the right or left as desired, and as indicated by the arrow 55 in FIG. 7**.

The tubular member 38 may be constructed as a battery holder for operating the motor 50. For this purpose the tubular member 38 is provided with an opening 41 for the insertion or removal of the batteries. Electrical contacts 52 are arranged at the end of the tubular member 38 and are electrically connected to a socket 42 for cooperation with an electric plug 43 connected through a multicore cable 44 to a control panel 45 equipped with keys 46 and 47 for controlling the operation of the motor 50 in one or the other direction. The motor 50 is connected through wires 50' to the plug-in socket 42. The control panel 47 may be secured directly to the typewriter housing, for example, adjacent to the keyboard K shown in FIG. 1. However, the control panel 45 may also take the form of a foot pedal switch arrangement.

Figure 9:
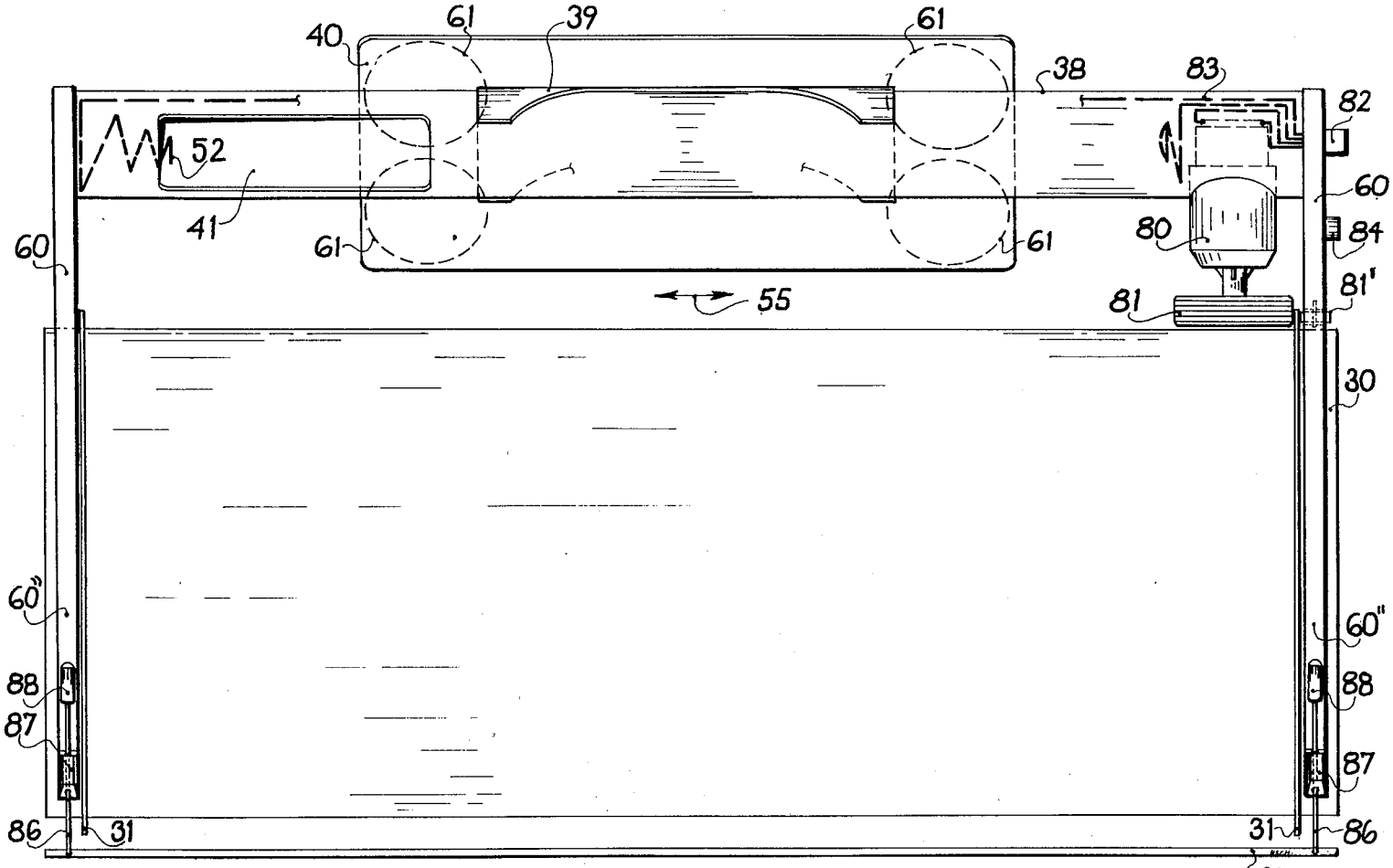
FIG. 9 is a top plan view onto the embodiment of FIG. 8.

FIGS. 8 and 9 illustrate an embodiment similar to that shown in FIGS. 6 and 7. Therefore, the same components in FIGS. 8 and 9 are provided with the same reference numbers as in FIGS. 6 and 7. The difference in FIGS. 8 and 9 resides in the mounting of the drive motor 80 directly to the tubular member 38 so that the friction drive wheel 81 cooperates with the right-hand flange 31 which is rigidly secured to the cylinder 30 for rotation with the cylinder 30. A friction control wheel 81' is rotatably secured in the holding bracket 60 and bears against the flange 31 substantially opposite the friction wheel 81. The electrical connection to the motor 80 for its forward and reverse drive control is accomplished by a socket 82 connected through wiring 83 to the motor 80 and to batteries which may be held in the tubular member 38. A plug-in socket 84 of conventional construction may be provided for a single pin double pole power supply plug to be used instead of the battery power supply.

The ruler 85 is secured to the upper arm 60" as shown in FIGS. 8 and 9 by respective wires 86 extending through a clamping groove 87 and provided with a handle 88, whereby the position of the ruler 85 is adjustable up and down. If desired, the ruler may also be secured to the lower holding arm 60' in respective holes 89.

Incidentally, the circumference of the drum and the length of the drum will depend upon the size of the sheets carrying the textual material. In order to be able to accommodate different sized sheets, a number of differing drum sizes may be made available.

Although the invention has been described with reference to specific example embodiments, it will be appreciated, that it is intended to cover all modifications and equivalents within the scope of the appended claims.

What is claimed is:

1. In an apparatus for holding a sheet containing information to be transcribed by a keyboard, the improvement comprising:

(a) a rotatable hollow cylinder having a longitudinal rotational axis, said hollow cylinder being made of transparent material for holding a sheet rolled up inside said hollow cylinder, said hollow cylinder having two open ends each with an unobstructed open surface for inserting said sheet into said hollow cylinder through either end without any interference with the sheet insertion, (b) means for rotatably supporting said hollow cylinder, said means for supporting comprising two forked members, each forked member having two elastically yielding curved arms to form a cradle type structure for rotatably holding said hollow cylinder on its outer surface substantially adjacent its open ends and leaving both said open ends unobstructed, said curved arms encircling said hollow cylinder only partially and being sufficiently flexible for permitting an easy insertion and withdrawal of said hollow cylinder substantially perpendicularly to and also lengthwise of said longitudinal rotational axis into and out of said cradle type structure without any tools, (c) said means for supporting further comprising a substantially round member extending in parallel to said rotational axis of said hollow cylinder, said substantially round member rigidly interconnecting said two forked members, clamping means partially encircling said substantially round member, and means secured to said clamping means for carrying said hollow cylinder through said clamping means, (d) and wherein said clamping means is made of relatively elastic material to function as a clamp for said substantially round member to provide a location clamp fit between said substantially round member and said clamping means, whereby said cradle type structure with the hollow cylinder held therein is adjustable in its position up and down, along a curve having its center in said substantially round member and back and forth along said substantially round member.

2. The apparatus of claim 1, further comprising electric drive motor means, said substantially round member comprising a hollow tubular member which supports said electric drive motor means independently of the position of said cradle type structure relative to said hollow tubular member, said hollow tubular member functioning as a battery holder for batteries providing a power source for said electric drive motor means, and a friction drive wheel driven by said drive motor means and engaging said outer surface of said hollow cylinder also independently of the position of said cradle type structure relative to said hollow tubular member.

3. The apparatus of claim 2, further comprising a friction control wheel, operatively arranged for cooperation with said friction drive wheel.

4. The apparatus of claim 1, wherein said means carrying said clamping means comprise velcro-type fastening means operatively arranged for securing said means carrying said clamping means to a typewriter or the like.

5. The apparatus of claim 1, further comprising ruler means, means operatively connecting said ruler means at the ends thereof to said two curved arms, so that said ruler means extend substantially in parallel to said rotational axis of said hollow cylinder and substantially in parallel to said substantially round member.

6. The apparatus of claim 1, further comprising axial stop means operatively arranged for preventing a lateral shifting of said hollow cylinder in said cradle type structure when said hollow cylinder is rotating.

7. The apparatus of claim 1, wherein said clamping means comprise a slotted pipe section at least partially encircling said substantially round member, said means for carrying said clamping means being secured to said slotted pipe section.

* * * * *